US011193317B2

(12) United States Patent
Nakamura

(10) Patent No.: US 11,193,317 B2
(45) Date of Patent: Dec. 7, 2021

(54) MOUNTING POSITION ADJUSTMENT MECHANISM FOR ROTATING DOOR, APPARATUS WITH ROTATING DOOR, AND IMAGE FORMING APPARATUS

(71) Applicant: Kenichi Nakamura, Kanagawa (JP)

(72) Inventor: Kenichi Nakamura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/918,094

(22) Filed: Jul. 1, 2020

(65) Prior Publication Data

US 2021/0025206 A1 Jan. 28, 2021

(30) Foreign Application Priority Data

Jul. 24, 2019 (JP) ..... JP2019-136112

(51) Int. Cl.

| | |
|---|---|
| ***E05D 7/00*** | (2006.01) |
| ***E05D 7/04*** | (2006.01) |
| ***G03G 21/16*** | (2006.01) |
| ***E05D 3/02*** | (2006.01) |

(52) U.S. Cl.

CPC ..... *E05D 7/0009* (2013.01); *E05D 3/02* (2013.01); *E05D 7/0415* (2013.01); *G03G 21/1633* (2013.01); *E05D 2007/0484* (2013.01); *E05Y 2900/608* (2013.01)

(58) Field of Classification Search

CPC ..... E05D 7/0415; E05D 7/0423; E05D 2007/0484; E05D 7/0045; E05D 7/0054

USPC ..... 16/245

See application file for complete search history.

(56) References Cited

U.S. PATENT DOCUMENTS

| | | | | |
|---|---|---|---|---|
| 37,684 | A * | 2/1863 | Eveleth et al. | E05D 7/0423 16/240 |
| 1,782,490 | A * | 11/1930 | Torgerson | E05D 7/0423 16/245 |
| 2,441,221 | A * | 5/1948 | Eckel | E05D 7/0423 16/245 |
| 4,720,896 | A * | 1/1988 | Lautenschlager | E05D 5/0276 16/236 |
| 7,350,272 | B2 * | 4/2008 | Fries | E05D 7/02 16/246 |
| 7,870,642 | B1 * | 1/2011 | Finkelstein | E05D 7/0423 16/260 |

(Continued)

FOREIGN PATENT DOCUMENTS

| | | |
|---|---|---|
| JP | 5-028079 | 4/1993 |

*Primary Examiner* — Jeffrey O'Brien

(74) *Attorney, Agent, or Firm* — Harness, Dickey & Pierce, P.L.C.

(57) ABSTRACT

A mounting position adjustment mechanism for a rotating door that is mounted to be rotatable around a shaft includes a base member, a support member, an adjuster, and a fixing member. The base member is configured to be fixed to a door body of the rotating door. The support member is coupled to the base member at one end side of the shaft to be movable along a door surface of the rotation door in a direction orthogonal to the shaft. The adjuster is configured to adjust a position of the support member with respect to the base member in the direction orthogonal to the shaft. The fixing member is configured to fix the support member to the base member at two or more positions on the one end side of the shaft.

18 Claims, 12 Drawing Sheets

(56) References Cited

U.S. PATENT DOCUMENTS

| | | | | |
|---|---|---|---|---|
| 8,020,253 | B1 * | 9/2011 | Finkelstein | E05D 11/0054 16/250 |
| 8,720,008 | B2 * | 5/2014 | Dodge | G16H 20/10 16/245 |
| 9,493,973 | B2 * | 11/2016 | Mitchell | E05D 7/0423 |
| 9,644,411 | B2 * | 5/2017 | Gompper | E05D 7/04 |
| 2016/0153221 | A1 * | 6/2016 | Dodge | E05D 7/0415 16/238 |
| 2017/0146282 | A1 * | 5/2017 | Dodge | E05D 7/0415 |

* cited by examiner

MOUNTING POSITION ADJUSTMENT MECHANISM FOR ROTATING DOOR, APPARATUS WITH ROTATING DOOR, AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-136112, filed on Jul. 24, 2019, in the Japan Patent Office, the entire disclosure of which is hereby incorporated by reference herein.

BACKGROUND

Technical Field

The present disclosure relates to a mounting position adjustment mechanism for a rotating door, an apparatus with the rotating door, and an image forming apparatus including the mounting position adjustment mechanism.

Description of the Related Art

A mounting position adjustment mechanism is known for a rotating door mounted to be rotatable around a predetermined shaft.

SUMMARY

In an aspect of the present disclosure, a mounting position adjustment mechanism for a rotating door that is mounted to be rotatable around a shaft includes a base member, a support member, an adjuster, and a fixing member. The base member is configured to be fixed to a door body of the rotating door. The support member is coupled to the base member at one end side of the shaft to be movable along a door surface of the rotation door in a direction orthogonal to the shaft. The adjuster is configured to adjust a position of the support member with respect to the base member in the direction orthogonal to the shaft. The fixing member is configured to fix the support member to the base member at two or more positions on the one end side of the shaft.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
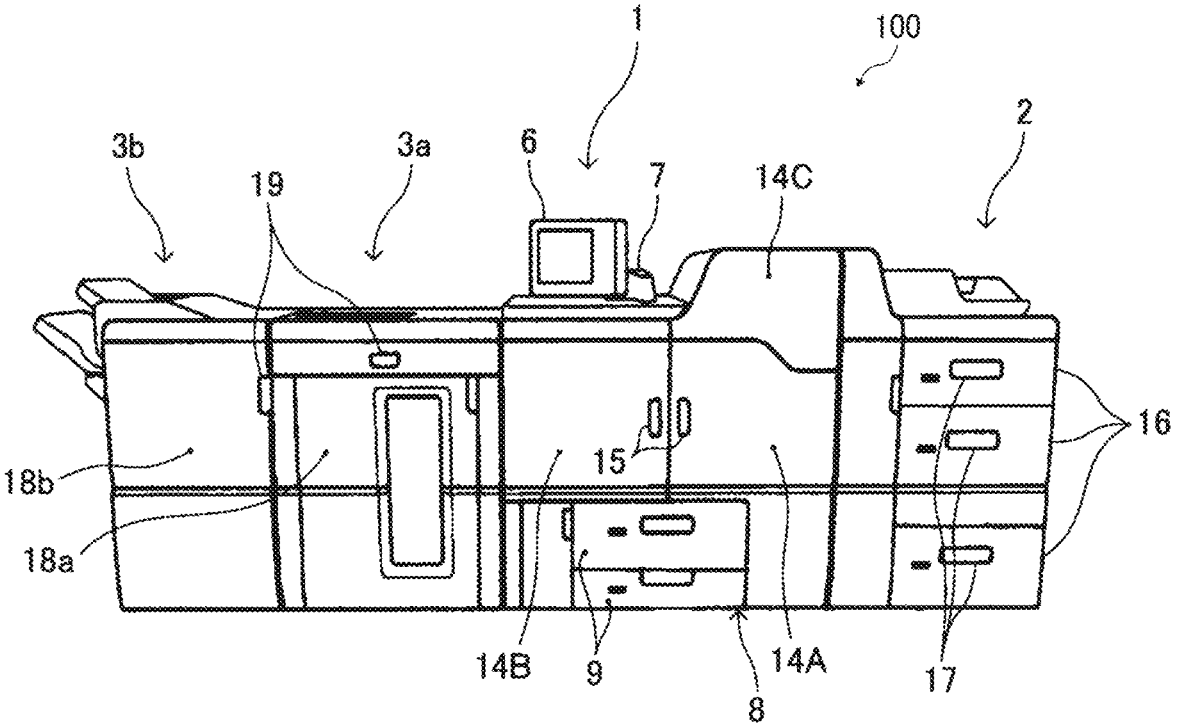
FIG. 1 is an external view of an example of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a description is given of a mounting position adjustment mechanism for a rotating door according to an embodiment of the present disclosure. The rotating door is attached to an apparatus body of an image forming unit as an image forming apparatus included in an image forming system to be rotatable around a predetermined shaft.

FIG. 1 is an external view of an example of an image forming system according to the present embodiment.

An image forming system 100 according to the present embodiment includes an image forming unit 1, a large-volume sheet feeding unit 2, a sheet stacking unit 3*a*, and a post-processing unit 3*b* that performs binding and the like. The image forming unit 1 is an image forming apparatus as an apparatus with a rotating door located substantially at the center of the image forming system 100 in FIG. 1.

Figure 2:
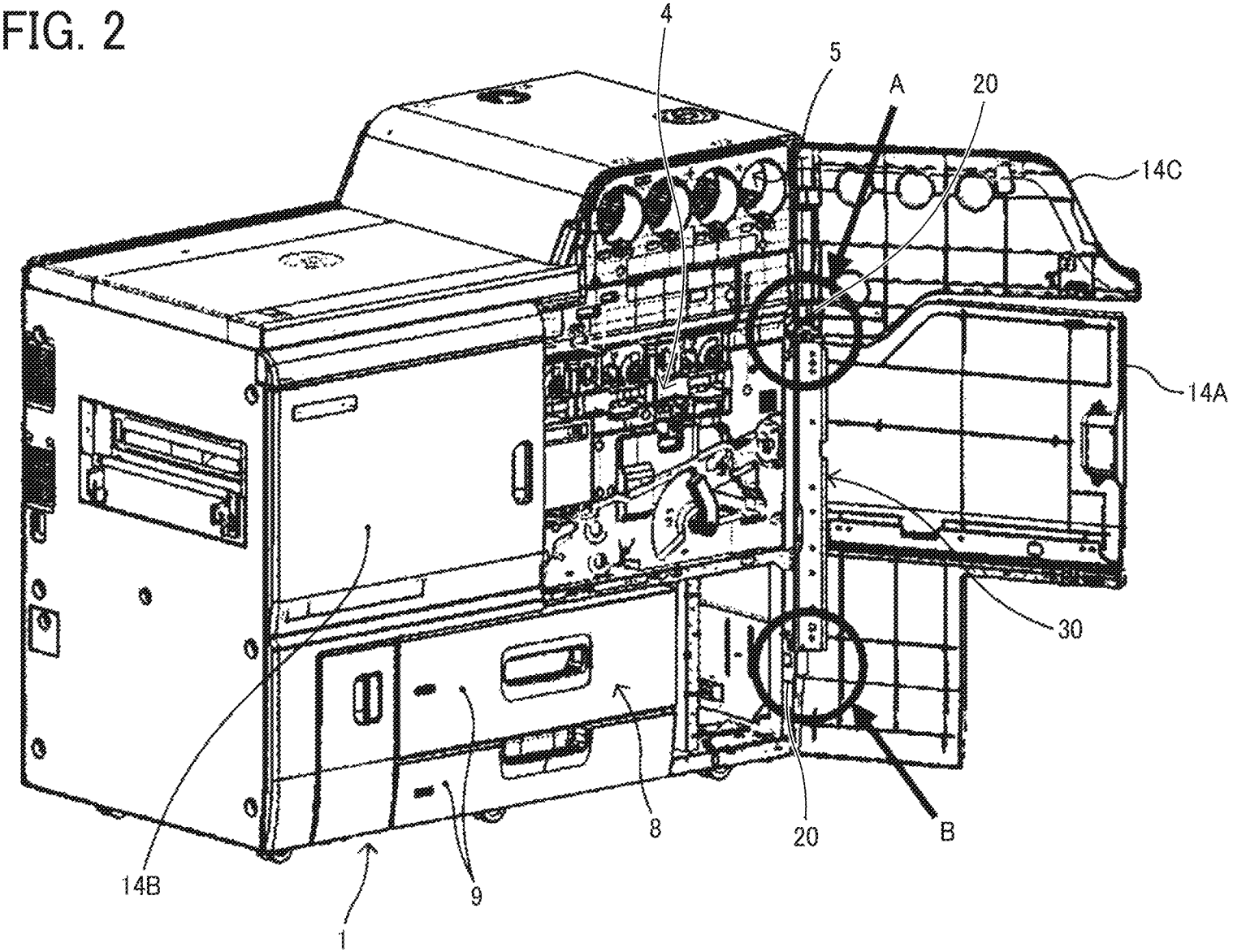
FIG. 2 is a perspective view of the image forming system in a state in which a right front door and an upper front door of an image forming unit included in the image forming system are opened to expose an inside of the image forming unit.

FIG. 2 is a perspective view of a state in which a right front door 14A and an upper front door 14C, which are rotating doors of the image forming unit 1 included in the image forming system 100 according to the present embodiment, are opened to expose an inside of the image forming unit 1.

The image forming unit 1 includes an image forming section 4 that forms an image in a substantially central portion of the image forming unit 1, and a toner bottle storage section 5 in an upper portion of the image forming unit 1. On an upper surface of the image forming unit 1, an operation display 6 is provided to be angularly variable via an arm 7. A sheet feeding section 8 is provided below the image forming unit 1. The sheet feeding section 8 includes two sheet feeding trays 9. An automatic document feeder (ADF) may be provided on the upper surface of the image forming unit 1.

Normally, in apparatuses such as various office automation (OA) apparatuses and other electronic apparatuses including the image forming unit 1, the large-volume sheet feeding unit 2, the sheet stacking unit 3*a*, and the post-processing unit 3*b* constituting the image forming system 100 of the present embodiment, an opening is provided in an apparatus body (housing) and a door is installed at the opening to be openable and closable because maintenance, inspection, repair, and the like of internal components are necessary.

Therefore, in the image forming system 100 of the present embodiment, doors 14A, 14B, 14C, 18*a*, and 18*b* are installed in the above-described units, and handles 15 and 19 to open and close the doors 14A, 14B, 14C, 18*a*, and 18*b* are provided. The large-volume sheet feeding unit 2 includes handles 17 to pull out the plurality of sheet feeding trays 16.

There are various types of doors provided in such a device. In the present embodiment, a rotating door having a simple configuration (a door that is opened and closed by rotating around a predetermined shaft) is adopted. However, in this case, since the door protrudes outside of the housing during the opening operation, it is necessary to secure a space from which the door can protrude outside of the apparatus in order to open and close the door. This space is desired to be as narrow as possible in consideration of the convenience of the user, and therefore a configuration in which two doors are provided with respect to the opening of the apparatus body is common. As the opening and closing system, a double door system in which left and right front doors are rotatably supported by hinge mechanisms provided at both left and right ends is preferred as a simple configuration.

In particular, in the image forming unit 1 of the present embodiment, as illustrated in FIG. 2, almost an entire area of the front surface of the image forming unit 1 is opened and the opening needs to be openable and closable by the two front doors 14A and 14B. Thus, the two front doors 14A and 14B are large, and a double door system is adopted to narrow the space for opening the two doors 14A and 14B with a simple configuration.

Here, when the two front doors 14A and 14B are provided as the double door system, a mounting position misalignment occurs between the front doors 14A and 14B or between the front doors 14A and 14B and covers adjacent to the front doors 14A and 14B, due to a component tolerance between the front doors 14A and 14B and members constituting the hinge mechanisms supporting the front doors 14A and 14B or between the front doors 14A and 14B and covers adjacent to the front doors 14A and 14B of the image forming unit 1. Such misalignment of the mounting positions of the front doors 14A and 14B can be kept within an allowable range by strictly controlling the dimensional tolerances of the components. However, strictly controlling the dimensional tolerances (accuracy) of the components leads to an increase in cost. In addition, there is a problem in that assembling becomes difficult due to insufficient dimensional margins between the components (insufficient gaps between the front doors and the covers or between the front doors).

Therefore, in the present embodiment, the mounting position adjustment mechanisms of the front doors 14A and 14B are provided to correct the misalignment or tilt that occurs between the front doors 14A and 14B or between the front doors 14A and 14B and the adjacent covers. In the following description, the mounting position adjustment mechanism of the right front door 14A is described as an example.

Figure 3:
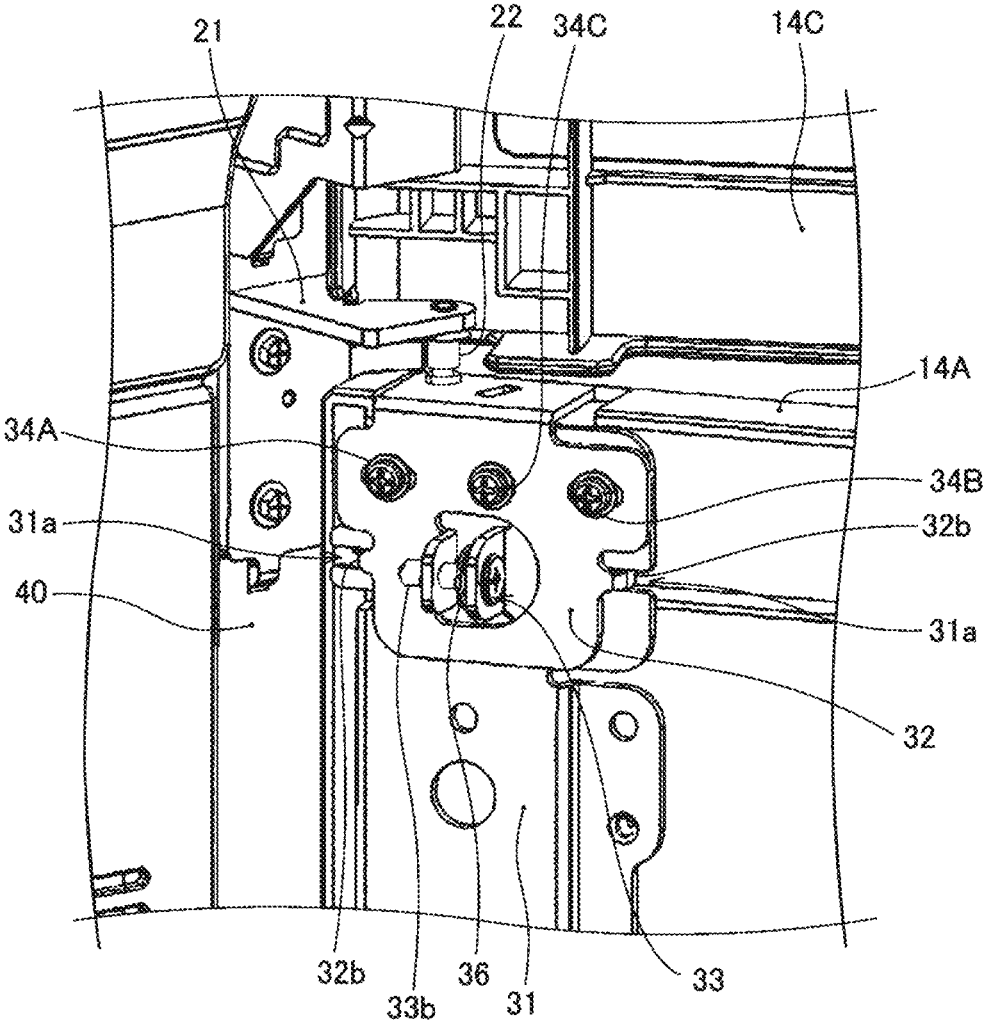
FIG. 3 is an enlarged view of a vicinity of an upper hinge in a hinge mechanism of the right front door (a portion indicated by arrow A in FIG. 2)

FIG. 3 is an enlarged view of the vicinity of an upper hinge in a hinge mechanism 20 of the right front door 14A (a portion indicated by arrow A in FIG. 2).

Figure 4:
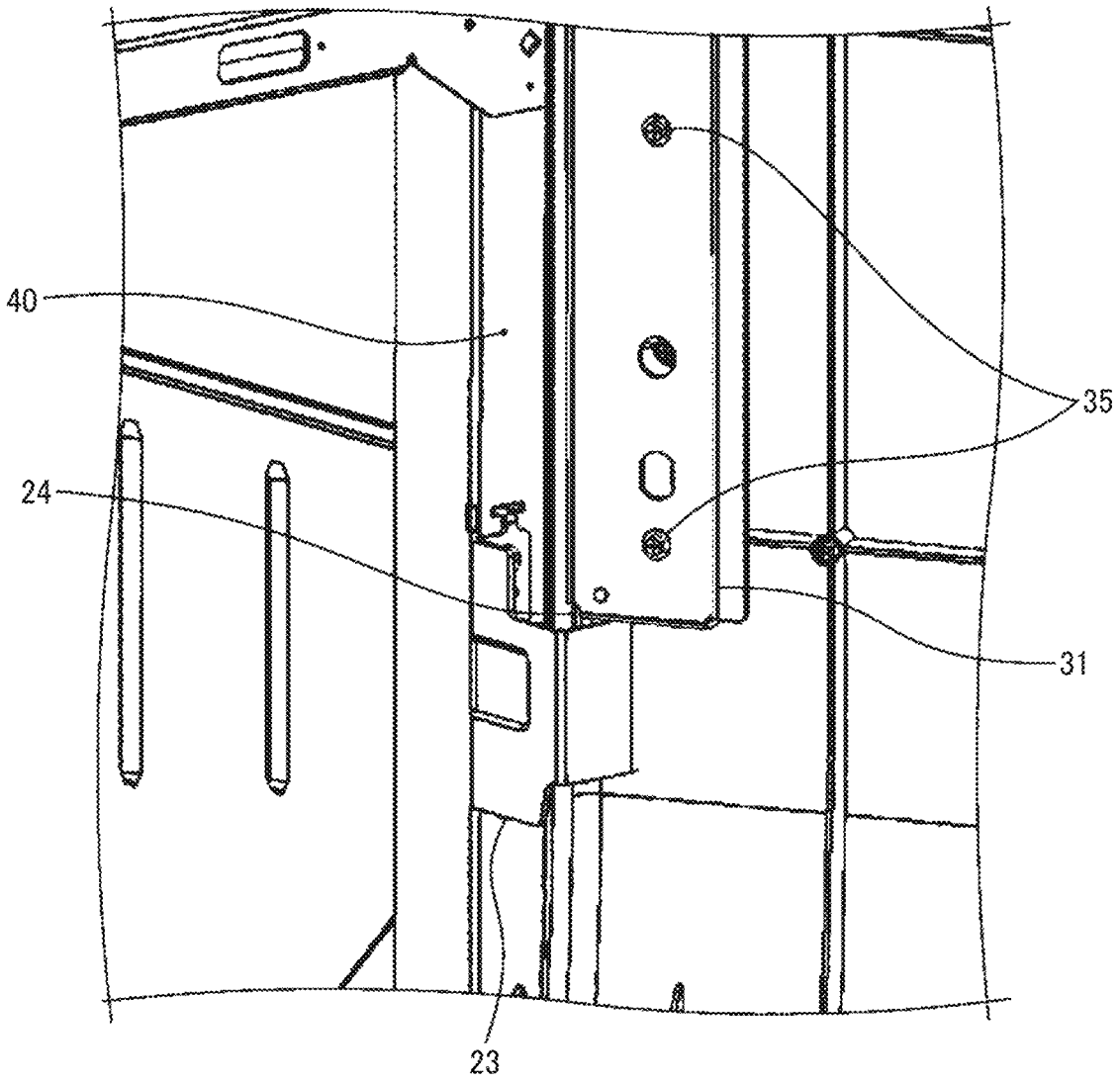
FIG. 4 is an enlarged view of a vicinity of a lower hinge in the hinge mechanism of the right front door (a portion indicated by arrow B in FIG. 2)

FIG. 4 is an enlarged view of the vicinity of a lower hinge in the hinge mechanism 20 of the right front door 14A (a portion indicated by arrow B in FIG. 2).

The right front door 14A is supported by an upper shaft 22 of an upper hinge 21 and a lower shaft 24 of a lower hinge 23 to be rotatable around the upper shaft 22 and the lower shaft 24. The upper shaft 22 and the lower shaft 24 are fixed to a front frame 40 of an apparatus body (housing) of the image forming unit 1. A mounting position adjustment mechanism 30 of the present embodiment adjusts the mounting position (mounting posture) of the right front door 14A supported by the upper hinge 21 and the lower hinge 23.

The mounting position adjustment mechanism 30 of the present embodiment includes a base attachment plate 31 and a position adjusting attachment plate 32 as members independent of each other. The base attachment plate 31 is a base member fixed to the rear surface of the door body of the right front door 14A. The position adjusting attachment plate 32 is a support member coupled to the base attachment plate 31. As illustrated in FIG. 2, the base attachment plate 31 is a long plate-shaped member extending in a vertical direction, and is fixed to a rear surface of the right front door 14A along a right end side of the right front door 14A. The base attachment plate 31 is fixed to face the rear surface of the right front door 14A over substantially an entire region in the vertical direction to obtain a sufficient strength to firmly support the large and heavy right front door 14A by the upper hinge 21 and the lower hinge 23.

Figure 5:
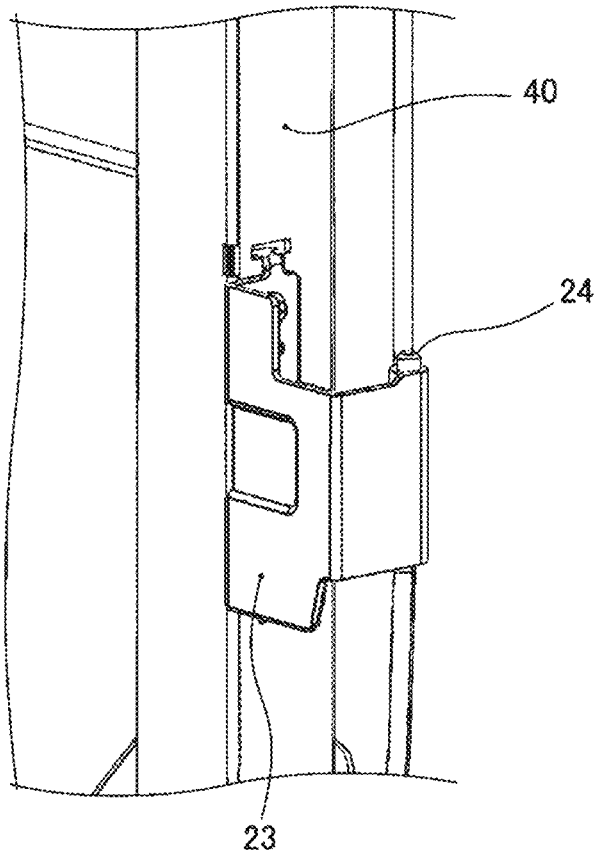
FIG. 5 is a perspective view of the lower hinge.

A bearing hole into which the lower shaft 24 of the lower hinge 23 is fitted as illustrated in FIG. 5 is formed in a lower end surface of the base attachment plate 31. The lower shaft 24 is fitted into the bearing hole, and the base attachment plate 31 is mounted on the lower hinge 23 to be placed on the lower hinge 23, whereby the right front door 14A to which the base attachment plate 31 is fixed is attached to the lower hinge 23 fixed to the front frame 40 of the apparatus body.

On the other hand, in the upper portion of the right front door 14A, the base attachment plate 31 fixed to the right front door 14A is not directly attached to the upper hinge 21 fixed to the front frame 40 of the apparatus body, but is attached to the upper hinge 21 via the position adjusting attachment plate 32 connected to the base attachment plate 31. That is, the upper shaft 22 of the upper hinge 21 is fitted into a bearing hole 32*a* of the position adjusting attachment plate 32 and is supported.

The position adjusting attachment plate 32 is connected to the base attachment plate 31 to be movable along a door surface (rear surface) of the right front door 14A in a direction orthogonal to the lower shaft 24 on one end side (upper shaft 22 side) of the upper shaft 22 and the lower shaft 24. Therefore, in the direction of movement of the position adjusting attachment plate 32, the position of the position adjusting attachment plate 32 with respect to the base attachment plate 31 is adjustable. By adjusting this position, for example, even if there is a mounting position misalignment of the right front door 14A as illustrated by arrow C in FIG. 6, the tilt angle of the right front door 14A with respect to each of the upper shaft 22 and the lower shaft 24 can be adjusted, and the mounting position (mounting posture) of the right front door 14A is adjusted as illustrated by arrow D in FIG. 6, so that the mounting position misalignment can be corrected.

Figure 7:
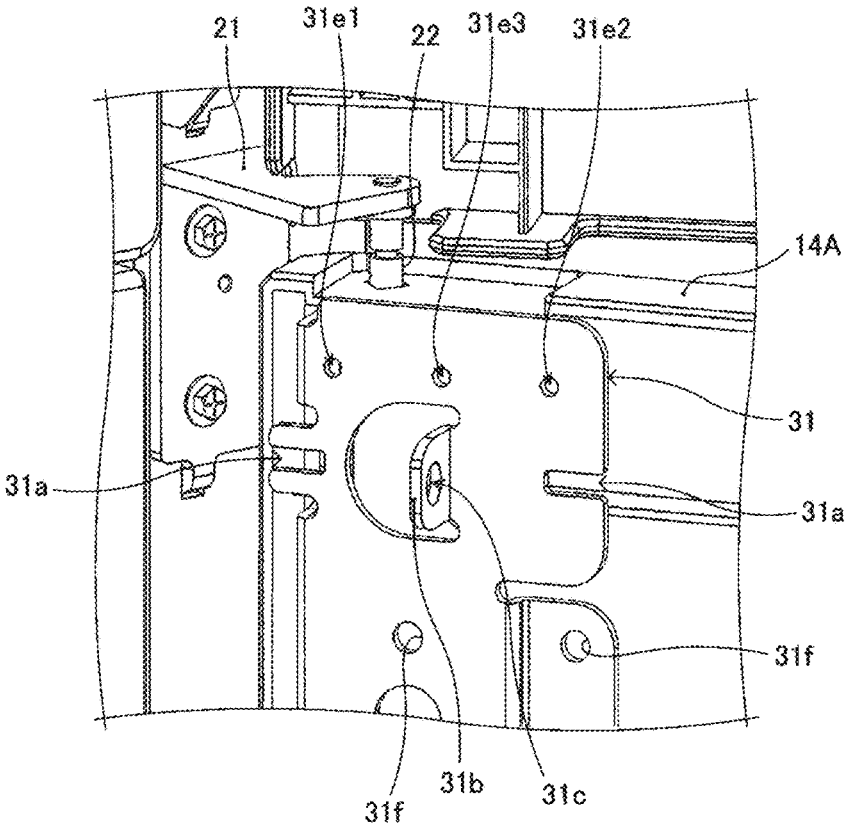
FIG. 7 is a perspective view of a base attachment plate fixed to a rear surface of the right front door.

FIG. 7 is a perspective view of the base attachment plate 31 fixed to the rear surface of the right front door 14A.

Figure 8:
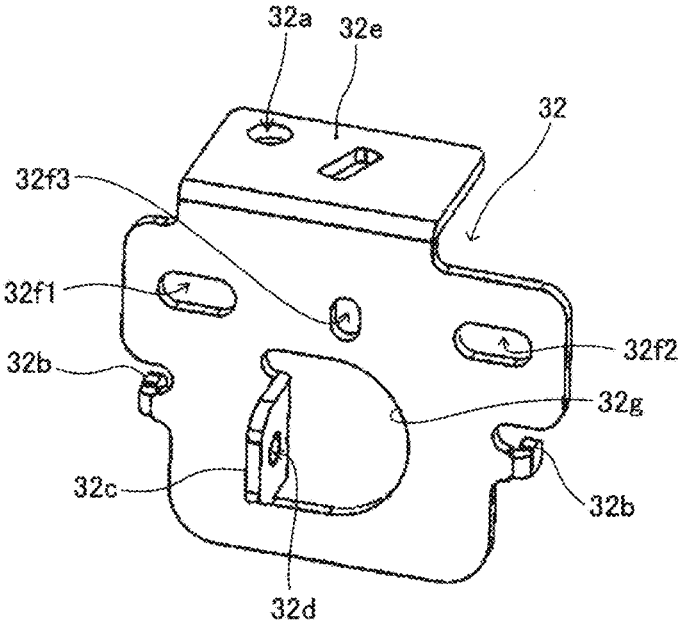
FIG. 8 is a perspective view of a position adjusting attachment plate coupled to the base attachment plate and attached to the rear surface of the right front door.

FIG. 8 is a perspective view of the position adjusting attachment plate 32 that is attached to the rear surface of the right front door 14A coupled with the base attachment plate 31.

Figure 9:
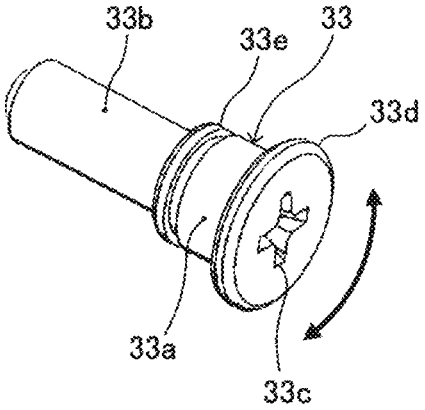
FIG. 9 is a perspective view of a position adjusting screw that adjusts the position of the position adjusting attachment plate with respect to the base attachment plate.

FIG. 9 is a perspective view of a position adjusting screw 33 as an adjuster to adjust the position of the position adjusting attachment plate 32 with respect to the base attachment plate 31.

The base attachment plate 31 includes guide grooves 31*a* at both lateral sides of one end thereof. Two protruding portions 32*b* as guide protrusions provided on the position adjusting attachment plate 32 are inserted into the guide grooves 31*a*, respectively. Each guide groove 31*a* is provided to extend in the moving direction of the position adjusting attachment plate 32 (the direction orthogonal to the upper shaft 22 and parallel to the door surface (rear surface) of the right front door 14A). Accordingly, when the position adjusting attachment plate 32 is coupled to the base attachment plate 31, the protruding portions 32*b* are guided by the guide grooves 31*a*, so that the position adjusting attachment plate 32 becomes movable in the moving direction in a state in which displacement in the vertical direction is restricted.

Further, as illustrated in FIG. 7, the base attachment plate 31 includes a fitting hole 31*c* into which a large-diameter fitting portion 33*a* of the position adjusting screw 33 is fitted in an upright plate 31*b* as a screw mounting portion extending perpendicularly from the plate surface of the base attachment plate 31. In addition, the base attachment plate 31 is formed with screw holes 31*e*1, 31*e*2, and 31*e*3. Three fastening screws 34A, 34B, and 34C are fastened to the screw holes 31*e*1, 31*e*2, and 31*e*3, respectively, to fix the position adjusting attachment plate 32 to the base attachment plate 31. The base attachment plate 31 also includes a plurality of fixing holes 31*f* into which a plurality of fixing screws 35 to fix the base attachment plate 31 to the rear surface of the right front door 14A are inserted.

As illustrated in FIG. 8, the position adjusting attachment plate 32 includes two protruding portions 32*b* as guide protrusions to be inserted into the guide grooves 31*a* provided in the base attachment plate 31. The two protruding portions 32*b* are provided at both lateral sides of the position adjusting attachment plate 32. The position adjusting attachment plate 32 includes a screw hole 32*d* to which a threaded portion 33*b* of the position adjusting screw 33 is fastened in an upright plate 32*c* as a screw mounting portion extending at a right angle from the surface of the position adjusting attachment plate 32. A bearing hole 32*a* into which the upper shaft 22 of the upper hinge 21 is fitted is formed in an upper end surface portion 32*e* of the position adjusting attachment plate 32. In addition, the position adjusting attachment plate 32 includes an upright plate insertion hole 32*g* into which the upright plate 31*b* of the base attachment plate 31 is inserted when the position adjusting attachment plate 32 is coupled to the base attachment plate 31.

The position adjusting attachment plate 32 includes through-holes 32*f*1, 32*f*2, and 32*f*3 into which three fastening screws 341, 34B, and 34C as fixing members to fix the position adjusting attachment plate 32 to the base attachment plate 31 are inserted. As illustrated in FIG. 8, two through-holes 32*f*1 and 32*f*2 among the through-holes 32*f*1, 32*f*2, and 32*f*3 have an elongated hole shape elongated in the moving direction of the position adjusting attachment plate 32. Accordingly, in a state in which the fastening screws 34A and 34B are loosened (in a state in which the fastening screw 34C is removed), the position adjusting attachment plate 32 can move in the moving direction while displacement in the axial direction (vertical direction) of the shafts 22 and 24 is restricted by the fastening screws 34A and 34B. Of the three through-holes 32*f*1, 32*f*2, and 32*f*3, the through-hole 32*f*3 has an elongated hole shape elongated in the vertical direction. Such a configuration can adjust the vertical position of the position adjusting attachment plate 32 with respect to the base attachment plate 31 and fix the position adjusting attachment plate 32 to the base attachment plate 31 with the fastening screw 34C.

The position adjusting screw 33 includes the large-diameter fitting portion 33*a* and the threaded portion 33*b*. The large-diameter fitting portion 33*a* is fitted into the fitting hole 31*c* formed in the uptight plate 31*b* of the base attachment plate 31 when the position adjusting attachment plate 32 is coupled to the base attachment plate 31. The threaded portion 33*b* is fastened to the screw hole 32*d* formed in the upright plate 32*c* of the position adjusting attachment plate 32. The position adjusting screw 33 includes a head portion 33*d* having a cross groove 33*c* into which a screwdriver is fitted.

Figure 10:
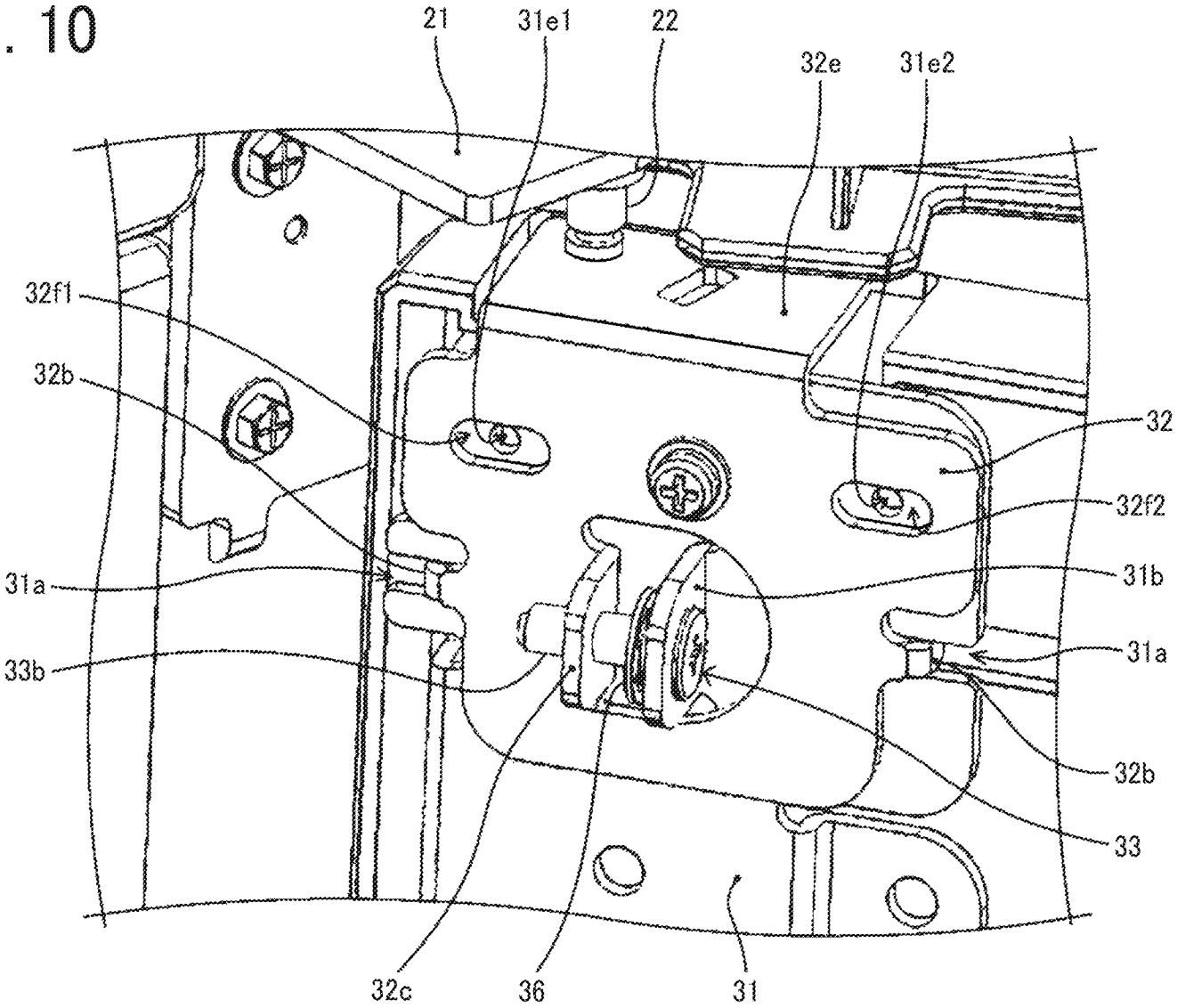
FIG. 10 is a perspective view of a state in which the position adjusting screw is fastened to a fitting hole of the base attachment plate and a screw hole of the position adjusting attachment plate.

As illustrated in FIG. 10, when the position adjusting attachment plate 32 is coupled with the base attachment plate 31, the threaded portion 33*b* of the position adjusting screw 33 is fastened to the screw hole 32*d* on the upright plate 32*c* of the position adjusting attachment plate 32. Accordingly, the large-diameter fitting portion 33*a* fits into the fitting hole 31*c* on the upright plate 31*b* of the base attachment plate 31 inserted into the upright plate insertion hole 32*g* of the position adjusting attachment plate 32. At this time, since an E-ring 36 is attached to an E-ring fitting groove 33*e* of the position adjusting screw 33, the head portion 33*d* of the position adjusting screw 33 is not displaced from the upright plate 31*b* of the base attachment plate 31.

Figure 11A:
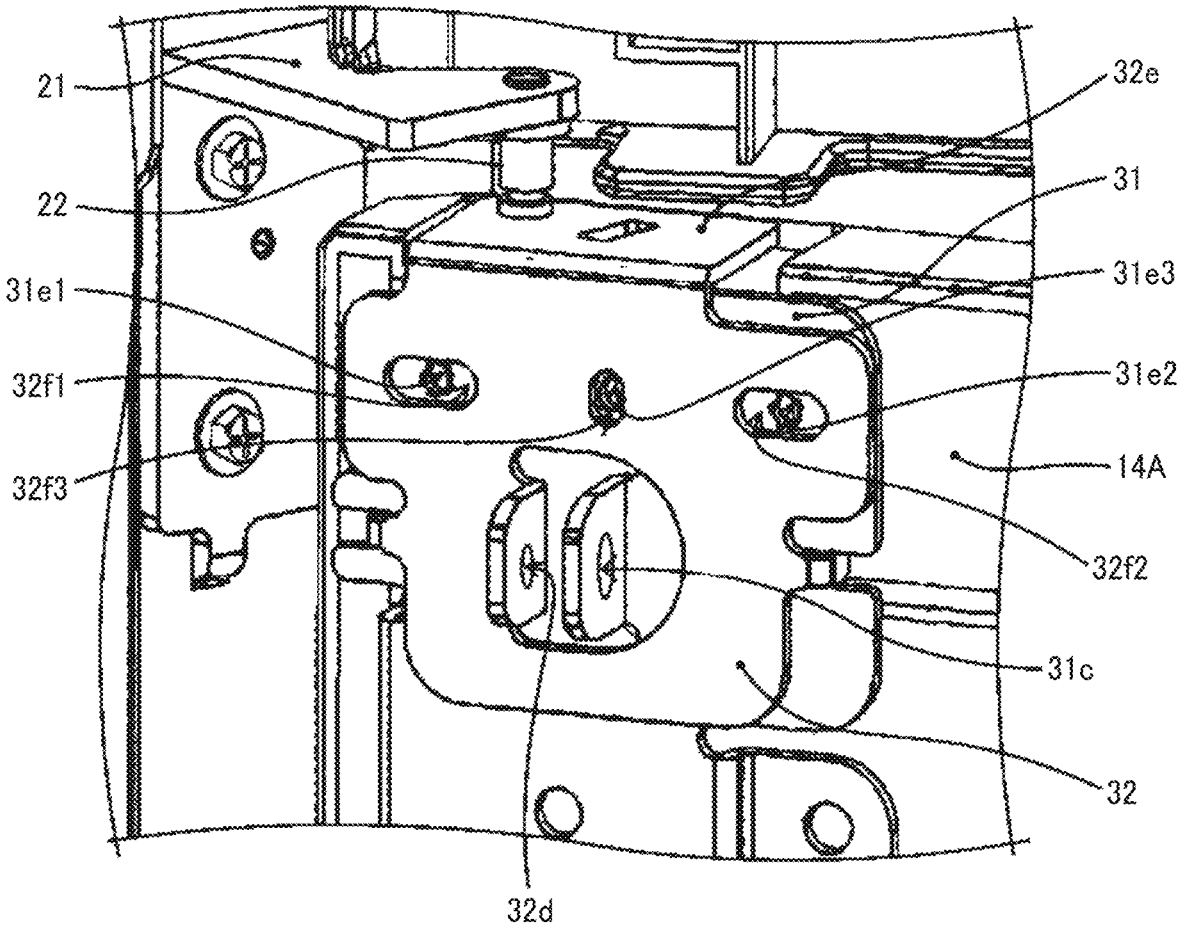
FIGS. 11A to 11C are explanatory views of a method of assembling the mounting position adjustment mechanism.
Figure 11B:
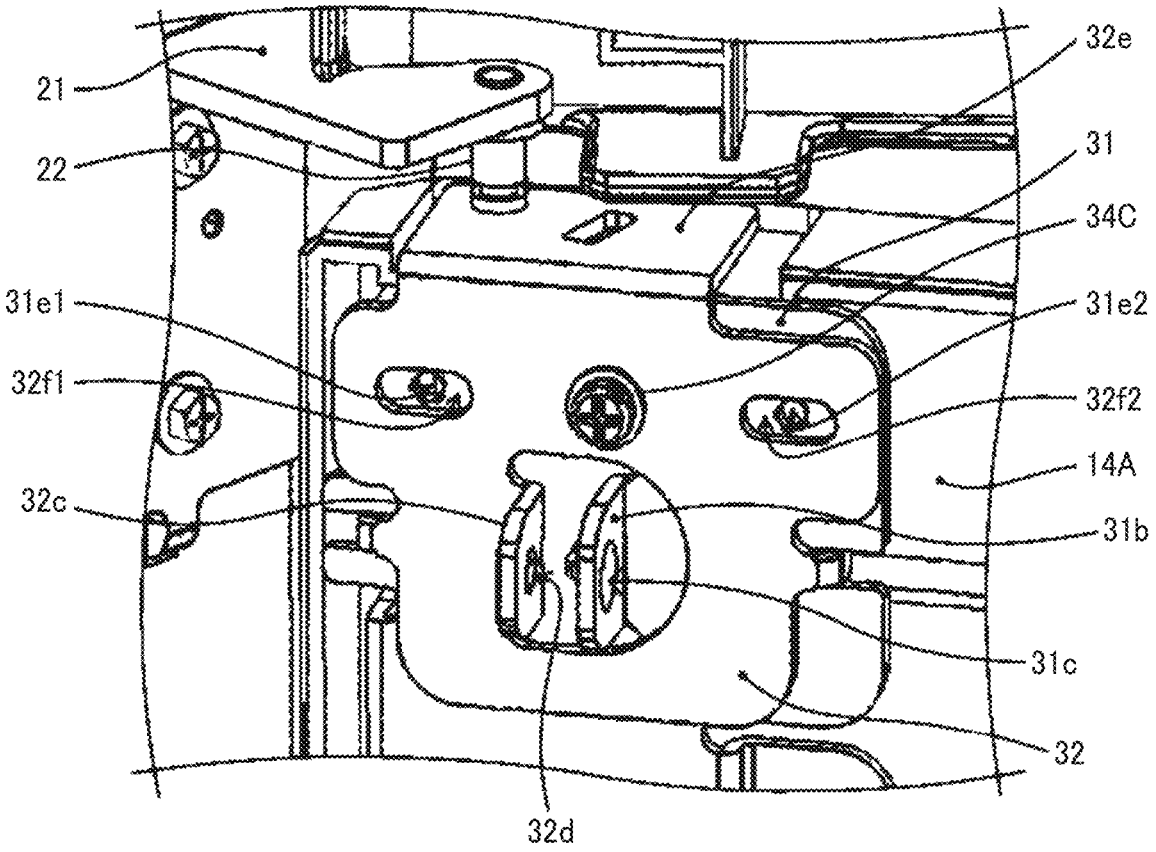
Figure 11C:
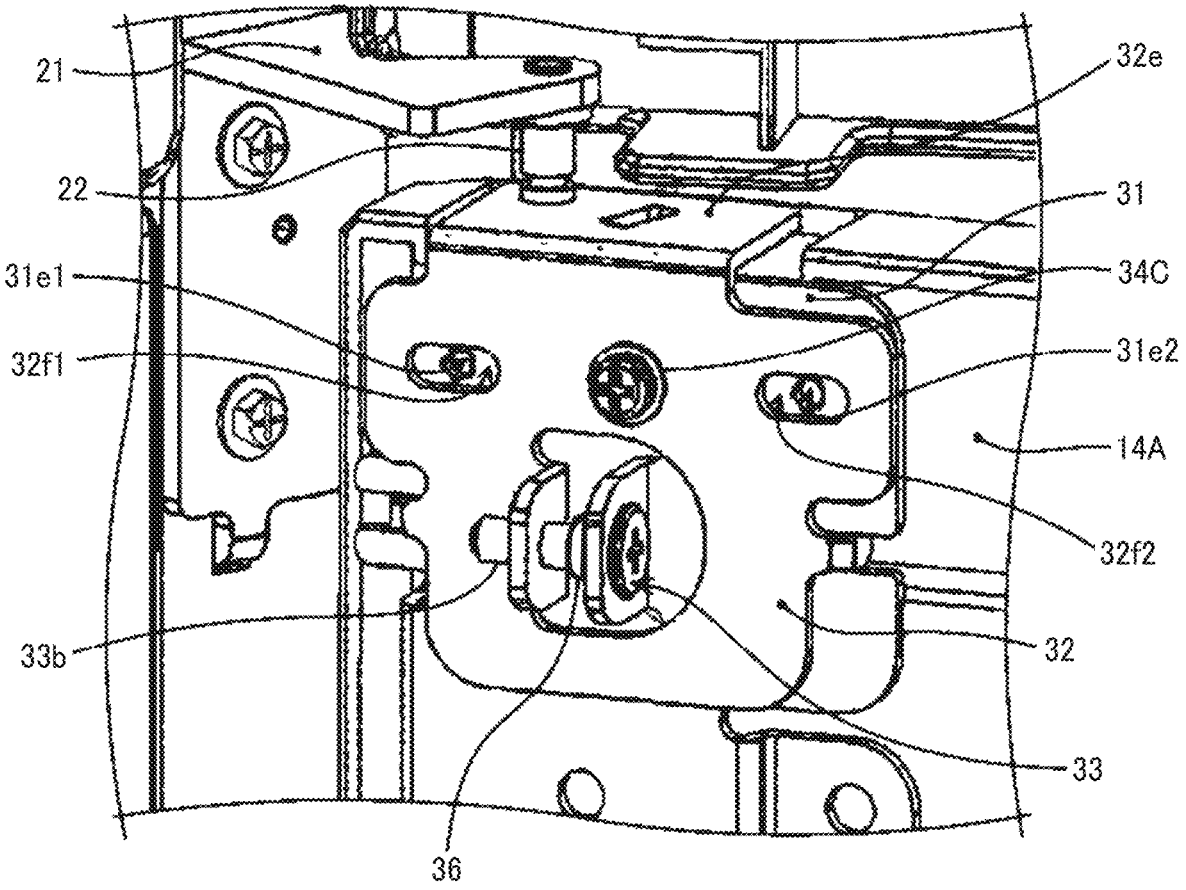

FIGS. 11A to 11C are explanatory views of a method of assembling the mounting position adjustment mechanism 30.

First, the base attachment plate 31 is fixed to the rear surface of the right front door 14A by the plurality of fixing screws 35. Then, the position adjusting attachment plate 32 is coupled with the base attachment plate 31 so that the upright plate 31*b* of the base attachment plate 31 is inserted into the upright plate insertion hole 32*g* of the position adjusting attachment plate 32. At this time, the protruding portions 32*b* of the position adjusting attachment plate 32 are fitted into the guide grooves 31*a* of the base attachment plate 31.

When the position adjusting attachment plate 32 is coupled with the base attachment plate 31 in this manner, as illustrated in FIG. 11A, the positions of the screw holes 31*e*1, 31*e*2, and 31*e*3 of the base attachment plate 31 coincide with the positions of the horizontally oblong through-holes 32*f*1 and 32*f*2 and the vertically oblong through-hole 32/1 of the position adjusting attachment plate 32. Then, as illustrated in FIG. 11B, the fastening screw 34C is inserted into the vertically oblong through-hole 32/3 of the position adjusting attachment plate 32 and fastened to the screw hole 31e3 of the base attachment plate 31, whereby the position adjusting attachment plate 32 is fixed to the base attachment plate 31.

Thereafter, as illustrated in FIG. 11C, the threaded portion 33b of the position adjusting screw 33 is fastened to the screw hole 32d on the upright plate 32c of the position adjusting attachment plate 32 so that the large-diameter fitting portion 33a of the position adjusting screw 33 is fitted into the fitting hole 31c on the upright plate 31b of the base attachment plate 31. Thereafter, the E-ring 36 is attached to the E-ring fitting groove 33e of the position adjusting screw 33.

Figure 6:
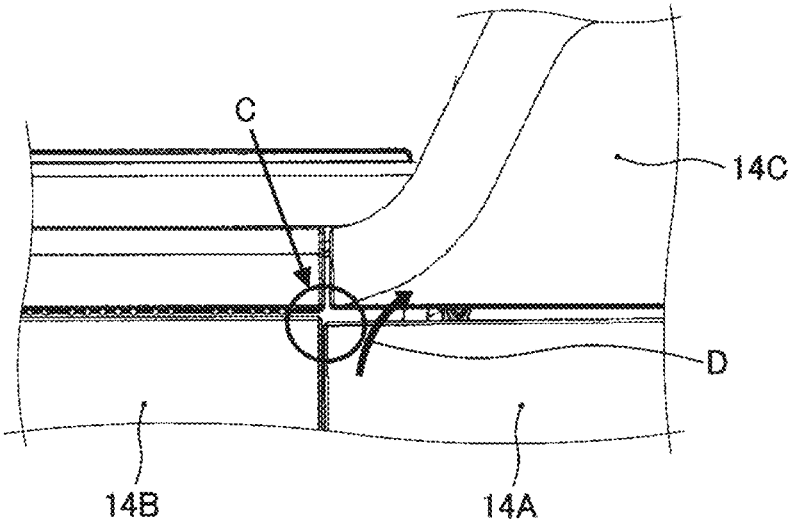
FIG. 6 is an explanatory view of a state in which a mounting position of the right front door is misaligned.

Since the positions of the vertically oblong through-hole 32/3 of the position adjusting attachment plate 32 and the screw hole 31e3 of the base attachment plate 31 are designed such that the right front door 14A is positioned at a normal attachment position, the attachment position of the right front door 14A as illustrated in FIG. 6 does not misalign unless there is a dimensional error of parts. At an initial time of factory assembly or the like, after the fastening screw 34C is fastened as described above, the remaining two fastening screws 34A and 34B are inserted into the horizontally oblong through-holes 32/1 and 32/2 of the position adjusting attachment plate 32 and fastened to the screw holes 31e1 and 31e2 of the base attachment plate 31, thereby fixing the position adjusting attachment plate 32 to the base attachment plate 31.

Figure 12:
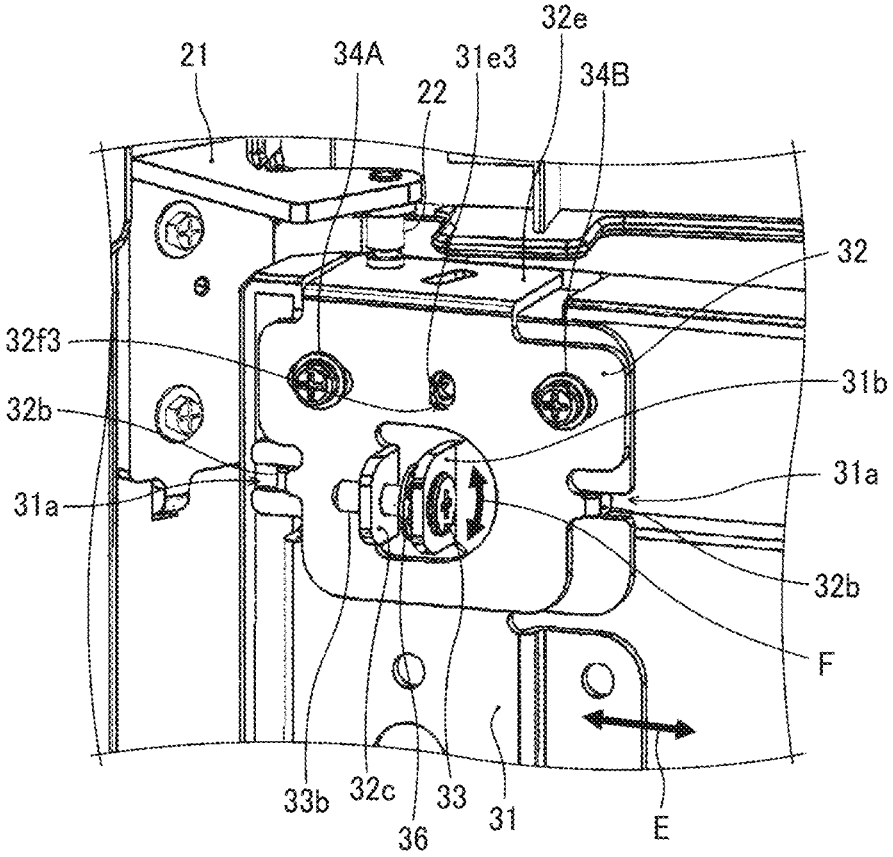
FIG. 12 is an explanatory view of a state in which the mounting position of the right front door is corrected by the mounting position adjustment mechanism.

In the present embodiment, for example, at the time of factory inspection or at the time of use by a user, when a mounting position misalignment such as misalignment or tilt is detected in the right front door 14A, the mounting position misalignment of the right front door 14A can be corrected by the mounting position adjustment mechanism 30 described above. In this case, first, among the three fastening screws 34A, 34B, and 34C, the fastening screw 34C inserted into the vertically oblong through-hole 32/3 of the position adjusting attachment plate 32 is removed, and the remaining two fastening screws 34A and 34B are loosened to be in a state as illustrated in FIG. 12. As a result, the protruding portions 32b of the position adjusting attachment plate 32 are guided by the guide grooves 31a of the base attachment plate 31, and the position adjusting attachment plate 32 can move in the moving direction (lateral direction) indicated by arrow E in FIG. 12 in a state in which displacement in the vertical direction is restricted (movable state).

Thereafter, by turning the position adjusting screw 33 in the directions indicated by arrow F in FIG. 12 with a screwdriver or the like, the distance between the upright plate 31b of the base attachment plate 31 and the upright plate 32c of the position adjusting attachment plate 32 is changed. Accordingly, the position adjusting attachment plate 32 can be moved in the directions indicated by arrow E in FIG. 12 (lateral directions) with respect to the base attachment plate 31. That is, the position of the position adjusting attachment plate 32 (in the moving direction) with respect to the base attachment plate 31 is finely adjustable according to the turning amount of the position adjusting screw 33.

When the position adjusting screw 33 is turned to adjust the position of the position adjusting attachment plate 32 with respect to the base attachment plate 31, an upper portion of the right front door 14A, to which the base attachment plate 31 is fixed, is separated from, or brought close to the upper hinge 21. As a result, the right front door 14A rotates around the lower shaft 24 of the lower hinge 23 such that the upper portion of the right front door 14A moves away from or approaches the upper hinge 21, and the tilt of the right front door 14A is adjusted.

When the mounting position misalignment of the right front door 14A is corrected in this manner, the two loosened fastening screws 34A and 34B are fastened to fix the position adjusting attachment plate 32 to the base attachment plate 31 (fixed state). At this time, since the position of the position adjusting attachment plate 32 in the moving direction (lateral direction) with respect to the base attachment plate 31 is adjusted as described above, the positions of the screw hole 31e3 of the base attachment plate 31 and the vertically oblong through-hole 32/3 of the position adjusting attachment plate 32 do not coincide with each other. Therefore, after the adjustment, the fastening screw 34C is not fastened.

In the present embodiment, the position adjusting attachment plate 32 is fixed to the base attachment plate 31 at two positions by the two fastening screws 34A and 34B even after the position of the position adjusting attachment plate 32 with respect to the base attachment plate 31 is adjusted. Such a configuration can fix the position adjusting attachment plate 32 more firmly than in a case in which the position adjusting attachment plate 32 is fixed at only one position after the position of the position adjusting attachment plate 32 with respect to the base attachment plate 31 is adjusted. Further, according to the position adjusting screw 33 of the present embodiment, even if the fastening screws 34A and 34B are slightly loosened and the fastening force is reduced, the position of the position adjusting attachment plate 32 is not displaced with respect to the base attachment plate 31 unless the position adjusting screw 33 is rotated. Therefore, the position adjusting screw 33 of the present embodiment also has an effect of restraining the misalignment of the right front door 14A in the directions in which the right front door 14A falls down (the longitudinal directions (two directions) of the horizontally oblong through-holes 32/1 and 32/2). Therefore, the position adjusting screw 33 can prevent a situation in which the position adjusting attachment plate 32 with respect to the base attachment plate 31 is shifted again after the adjustment.

In the present embodiment, as illustrated in FIG. 12, the positions of the uptight plates 31b and 32c to which the position adjusting screws 33 are attached and the positions of the guide grooves 31a are substantially aligned in the axial direction (vertical direction) of the shafts 22 and 24. Therefore, when the position adjusting screw 33 is turned to change the distance between the upright plates 31b and 32c, the two protruding portions 32b are prevented from moving obliquely with respect to the groove direction of the guide grooves 31a, thus allowing smooth movement of the position adjusting attachment plate 32 with respect to the base attachment plate 31.

In the present embodiment, the mounting position adjustment mechanism 30 that adjusts the attachment positions of the front doors 14A and 14B of the image forming unit 1 serving as an image forming apparatus has been described as an example. However, the same applies to other apparatuses for example, the sheet stacking unit 3a and the post-processing unit 3b) with rotating doors in the present image forming system 100, apparatuses with rotating doors used in any system other than the image forming system, and the like.

The embodiments described above are examples, and the following aspects of the present disclosure can attain, for example, the following effects.

Aspect 1

According to Aspect a mounting position adjustment mechanism (for example, the mounting position adjustment mechanism 30) for a rotating door mounted to be rotatable around a predetermined shaft (for example, the predetermined shaft 22 or 24) includes a base member (for example, the base attachment plate 31) to be fixed to a door body of the rotating door, a support member (for example, the position adjusting attachment plate 32) connected to the base member to be movable along a door surface of the rotating door in a direction orthogonal to the shaft on one end side (for example, the upper shaft 22 side) of the shaft, an adjuster (for example, the position adjusting screw 33) to adjust a position of the support member with respect to the base member, a fixing member (for example, the fastening screw 34A or 34B) to fix the support member with respect to the base member at two or more positions on the one end side of the shaft.

In Aspect 1, the adjuster moves the support member along the door surface of the rotating door in the direction orthogonal to the shaft at a location shifted toward the one end side of the shaft to adjust the position of the support member with respect to the base member, thereby tilting the rotating door with respect to the shaft and adjusting the mounting position of the rotating door. In Aspect 1, the support member that is moved when adjusting the mounting position of the rotating door is fixed to the base member by the fixing member with respect to the base member that is fixed to the door body of the rotating door. At this time, the support member is fixed to the base member at two or more positions on the one end side of the shaft. Accordingly, the support member after the position of the support member with respect to the base member is adjusted, can be fixed more firmly than a case in which the support member is fixed at only one position on one end side of the shaft. In addition, in Aspect 1, even if the fixing force of the fixing member is reduced, the relative position of the support member with respect to the base member can be prevented from being changed unless the adjuster is moved. Therefore, the support member can be fixed to the base member with sufficient fixing strength after the adjustment of the mounting position, thus reducing a situation in which the mounting position of the rotating door is shifted again after the adjustment.

Aspect 2

According to Aspect 2, in Aspect 1, the fixing member is switchable between a fixed state in which the support member is fixed to the base member and a movable state in which the support member is movable.

According to Aspect 2, switching the fixing member from the fixed state to the movable state can adjust the position of the support member with respect to the base member.

Aspect 3

According to Aspect 3, in the fixing member of Aspect 2, screws (for example, the fastening screws 34A and 34B) are inserted into two or more through-holes (for example, the oblong through-holes **32*f*1 and 32*f*2), respectively, provided in the support member to fix the support member to the base member and to set the fixed state and the screws are loosened to set the movable state. The through-holes (for example, the oblong through-holes 32*f*1 and 32*f*2**) have an oblong shape such that, in a state in which the screws are loosened, the displacement of the support member in an axial direction of the shaft is restricted by the screws and the movement of the support member in the direction orthogonal to the shaft is not restricted by the screws.

According to Aspect 3, the switching of the fixing member from the fixed state to the movable state is achievable with a simple configuration.

Aspect 4

In Aspect 4, in any one of Aspects 1 to 3, the adjuster includes a screw (for example, the position adjusting screw 33) to change a relative position of the support member with respect to the base member in the direction orthogonal to the shaft in accordance with a turning amount of the screw.

According to Aspect 4, finely adjusting the position of the support member with respect to the base member is easy, thus allowing more fine adjustment of the mounting position of the rotating door. Further, according to Aspect 4, even if the fixing force of the fixing member is reduced, the relative position of the support member with respect to the base member can be prevented from being changed unless the screw is rotated. Therefore, a situation in which the mounting position of the rotating door is shifted again after the adjustment is unlikely to occur.

Aspect 5

According to Aspect 5, in Aspect 4, guide grooves (for example, the guide grooves **31*a*) provided in one of the base member and the support member and extending in the direction orthogonal to the shaft, and guide projections (for example, the protruding portions 32*b*) provided in the other of the base member and the support member and guided by the guide grooves (for example, guide grooves 31*a*) are provided. The adjuster turns the screw (for example, the position adjusting screw 33), which is mounted to a screw mounting portion (for example, the upright plate 32*c*) of the support member, to adjust a distance between a screw mounting portion (for example, the upright plate 31*b*) of the base member and the screw mounting portion (for example, the upright plate 32*c***) of the support member in the direction orthogonal to the shaft. The positions of the screw mounting portions and the positions of the guide grooves in the axial direction of the shaft are substantially aligned.

According to such a configuration, when the screw is turned to change the distance between the screw mounting portions, the guide projections are restrained from moving obliquely with respect to a groove direction of the guide grooves, and allows smooth movement of the support member with respect to the base member.

Aspect 6

In Aspect 6, in any one of Aspects 1 to 5, the support member rotatably supports the shaft (for example, the upper shaft 22) provided on an apparatus body (for example, the front frame 40).

According to such a configuration, since the shaft is provided on the apparatus body, the number of components of the rotating door can be reduced.

Aspect 7

In Aspect 7, there is provided an apparatus with a rotating door (for example, the image forming unit 1). The rotating door is rotatably mounted around a predetermined shaft. The apparatus includes the mounting position adjustment mechanism according to any one of Aspects 1 to 6.

According to Aspect 7, an apparatus with a rotating door can be provided that can fix the support member with sufficient fixing strength after adjustment of the mounting position to the base member and can restrain a situation in which the mounting position of the rotating door is shifted again after the adjustment of the mounting position.

Aspect 8

In Aspect 8, an image forming apparatus (for example, the image forming unit 1) includes a predetermined shaft and a rotating door that is mounted to be rotatable around the predetermined shaft. The image forming apparatus includes the mounting position adjustment mechanism for the rotating door according to any one of Aspects 1 to 6.

According to Aspect 8, an image forming apparatus can be provided that can fix the support member with sufficient fixing strength after adjustment of the mounting position to the base member and can restrain a situation in which the mounting position of the rotating door is shifted again after the adjustment of the mounting position.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present disclosure.

What is claimed is:

1. A mounting position adjustment mechanism for a rotatable door, the door being mounted to be rotatable around a shaft, the mounting position adjustment mechanism comprising:

a base member, including a first plate, configured to be fixed to a door body of the rotatable door;

a support member, including a second plate, coupled to the base member at one end side of the shaft, the support member being fixed to the base member on the one end side of the shaft and being movable along a door surface of the rotation door in a direction orthogonal to the shaft;

an adjuster, including a screw, configured to adjust a position of the support member with respect to the base member in the direction orthogonal to the shaft; and one of the support member and the base member including a pair of guide protrusions extending from the one of the support member and the base member, another of the base member and the support member including a pair of guide grooves, the pair of guide grooves being formed in the another of the base member and the support member and being configured to guide the pair of guide protrusions, one of the support member and the base member including a first screw mounting portion extending from the one of the support member and the base member, another of the base member and the support member including a second screw mounting portion extending from the another of the base member and the support member, and one of the first screw mounting portion and the second screw mounting portion being configured to extend through an opening in one of the base member and the support member, for connection of the base member and the support member via the adjuster.

2. The mounting position adjustment mechanism of claim 1, further comprising:

a fixing member, including at least one screw, switchable between a fixed state and a movable state, to fix the support member to the base member in a fixed state, the support member being movable in a movable state.

3. The mounting position adjustment mechanism of claim 2, wherein the at least one screw of the fixing member includes a plurality of screws for insertion into two or more through-holes provided in the support member to fix the support member to the base member, the plurality of screws being configured to be loosened to make the support member movable, and wherein the through-holes have an oblong hole shape, wherein, in a state in which the screws are loosened, displacement of the support member in an axial direction of the shaft is restricted by the screws, and wherein movement of the support member in the direction orthogonal to the shaft is not restricted by the screws in a state in which the screws are loosened.

4. The mounting position adjustment mechanism of claim 1, wherein the screw of the adjuster is configured to change a relative position of the support member with respect to the base member in the direction orthogonal to the shaft in accordance with a turning amount of the screw.

5. The mounting position adjustment mechanism of claim 4, wherein the screw of the adjuster, mounted through the first screw mounting portion and the second screw mounting portion, is configured to, when turned, adjust a distance between the first screw mounting portion and the second screw mounting portion in the direction orthogonal to the shaft, and wherein, positions of the first screw mounting portion and the second screw mounting portion and a position of the guide groove in an axial direction of the shaft coincide.

6. The mounting position adjustment mechanism of claim 1, wherein the support member is configured to rotatably supports the shaft provided in an apparatus body.

7. The mounting position adjustment mechanism of claim 1, wherein each respective guide protrusion of the pair of guide protrusions, and each respective guide groove of the pair of guide grooves, are located outside both ends of the adjuster in the direction orthogonal to the shaft.

8. The mounting position adjustment mechanism of claim 1, wherein the adjuster is between two positions, where the support member is fixed to the base member, in the direction orthogonal to the shaft.

9. An apparatus including a rotatable door, mounted to be rotatable around a shaft, the apparatus further comprising a mounting position adjustment mechanism for the rotatable door, the mounting position adjustment mechanism including:

a base member, including a first plate, configured to be fixed to a door body of the rotatable door;

a support member, including a second plate, coupled to the base member at one end side of the shaft, the support member being fixed to the base member on the one end side of the shaft and being movable along a door surface of the rotation door in a direction orthogonal to the shaft;

an adjuster, including a screw, configured to adjust a position of the support member with respect to the base member in the direction orthogonal to the shaft; and one of the support member and the base member including a pair of guide protrusions extending from the one of the support member and the base member, another of the base member and the support member including a pair of guide grooves, the pair of guide grooves being formed in the another of the base member and the support member and being configured to guide the pair of guide protrusions, one of the support member and the base member including a first screw mounting portion extending from the one of the support member and the base member, another of the base member and the support member including a second screw mounting portion extending from the another of the base member and the support member, and one of the first screw mounting portion and the second screw mounting portion being configured to extend through an opening in one of the base member and the support member, for connection of the base member and the support member via the adjuster.

10. The apparatus of claim 9, wherein each respective guide protrusion of the pair of guide protrusions, and each respective guide groove of the pair of guide grooves, are located outside both ends of the adjuster in the direction orthogonal to the shaft.

11. The apparatus of claim 9, wherein the adjuster is between two positions, where the support member is fixed to the base member, in the direction orthogonal to the shaft.

12. The apparatus of claim 9, wherein the screw of the adjuster is configured to change a relative position of the support member with respect to the base member in the direction orthogonal to the shaft in accordance with a turning amount of the screw.

13. The apparatus of claim 12, wherein the screw of the adjuster, mounted through the first screw mounting portion and the second screw mounting portion, is configured to, when turned, adjust a distance between the first screw mounting portion and the second screw mounting portion in the direction orthogonal to the shaft, and wherein, positions of the first screw mounting portion and the second screw mounting portion and a position of the guide groove in an axial direction of the shaft coincide.

14. An image forming apparatus comprising:

a shaft;

a rotatable door, mounted to be rotatable around the shaft; and a mounting position adjustment mechanism for the rotatable door, the mounting position adjustment mechanism including:

a base member, including a first plate, configured to be fixed to a door body of the rotatable door;

a support member, including a second plate, coupled to the base member at one end side of the shaft, the support member being fixed to the base member on the one end side of the shaft and being movable along a door surface of the rotation door in a direction orthogonal to the shaft;

an adjuster, including a screw, configured to adjust a position of the support member with respect to the base member in the direction orthogonal to the shaft; and one of the support member and the base member including a pair of guide protrusions extending from the one of the support member and the base member, another of the base member and the support member including a pair of guide grooves, the pair of guide grooves being formed in the another of the base member and the support member and being configured to guide the pair of guide protrusions, one of the support member and the base member including a first screw mounting portion extending from the one of the support member and the base member, another of the base member and the support member including a second screw mounting portion extending from the another of the base member and the support member, and one of the first screw mounting portion and the second screw mounting portion being configured to extend through an opening in one of the base member and the support member, for connection of the base member and the support member via the adjuster.

15. The image forming apparatus of claim 14, wherein each respective guide protrusion of the pair of guide protrusions, and each respective guide groove of the pair of guide grooves, are located outside both ends of the adjuster in the direction orthogonal to the shaft.

16. The image forming apparatus of claim 14, wherein the adjuster is between two positions, where the support member is fixed to the base member, in the direction orthogonal to the shaft.

17. The image forming apparatus of claim 14, wherein the screw of the adjuster is configured to change a relative position of the support member with respect to the base member in the direction orthogonal to the shaft in accordance with a turning amount of the screw.

18. The image forming apparatus of claim 17, wherein the screw of the adjuster, mounted through the first screw mounting portion and the second screw mounting portion, is configured to, when turned, adjust a distance between the first screw mounting portion and the second screw mounting portion in the direction orthogonal to the shaft, and wherein, positions of the first screw mounting portion and the second screw mounting portion and a position of the guide groove in an axial direction of the shaft coincide.

* * * * *